US006656027B2

(12) United States Patent
Dietrich

(10) Patent No.: US 6,656,027 B2
(45) Date of Patent: Dec. 2, 2003

(54) GRINDING MACHINE

(75) Inventor: Harald Dietrich, Niefern (DE)

(73) Assignee: Otec Präzisionsfinish GmbH, Straubenhardt-Feldrennach (DE)

( * ) Notice: Subject to any disclaimer, the term of this patent is extended or adjusted under 35 U.S.C. 154(b) by 57 days.

(21) Appl. No.: 09/985,221

(22) Filed: Nov. 2, 2001

(65) Prior Publication Data

US 2002/0055327 A1 May 9, 2002

(30) Foreign Application Priority Data

Nov. 3, 2000 (DE) ..... 200 18 805

(51) Int. Cl.[7] ..... B24B 31/00
(52) U.S. Cl. ..... 451/327; 451/326; 451/328
(58) Field of Search ..... 451/32, 35, 74, 451/103, 104, 106, 109–113, 118, 326, 327, 328

(56) References Cited

U.S. PATENT DOCUMENTS

| | | | | | |
|---|---|---|---|---|---|
| 4,939,871 | A | * | 7/1990 | Ditscherlein | 451/327 |
| 5,012,620 | A | * | 5/1991 | McNeil | 451/32 |
| 5,279,074 | A | * | 1/1994 | Davidson | 451/326 |
| 5,476,415 | A | * | 12/1995 | Nishimura et al. | 451/326 |
| 5,823,861 | A | * | 10/1998 | Kobayashi et al. | 451/326 |
| 6,213,854 | B1 | * | 4/2001 | Gegenheimer | 451/326 |
| 6,296,556 | B1 | * | 10/2001 | Gegenheimer | 451/326 |
| 6,379,233 | B1 | * | 4/2002 | Kobayashi et al. | 451/326 |

* cited by examiner

*Primary Examiner*—Joseph J. Hail, III
*Assistant Examiner*—Anthony Ojini
(74) *Attorney, Agent, or Firm*—Paul Vincent

(57) ABSTRACT

In a grinding machine comprising a stationary wall part and a plate part which rotates about an axis of rotation, between which a gap is formed, the gap is limited from above by a ceramic part and from below by an elastic part.

7 Claims, 2 Drawing Sheets

GRINDING MACHINE

This application claims Paris Convention priority of DE 200 18 805.4 filed Nov. 3, 2000 the complete disclosure of which is hereby incorporated by reference.

BACKGROUND OF THE INVENTION

The invention concerns a grinding machine having a stationary wall part and a plate part, which can rotate about an axis of rotation, wherein a gap is formed between the stationary wall part and the plate part.

A grinding machine of this type is disclosed in DE 196 06 117 A1. Such a grinding machine operates under the influence of centrifugal force. Workpieces to be treated and grinding material are disposed within the inner space formed by the wall and the plate part, and rotated through rotation of the plate part to effect a polishing effect through the influence of centrifugal forces and the relative speeds between the workpieces and grains of grinding material.

In a known embodiment, the annular gap between the rotary plate part and the stationary wall part is limited from the upper side by an elastic lining of the wall part, and, on the lower side, by a ceramic ring disposed on the rotary plate. The ceramic ring has a rectangular cross-section. The plate part is formed directly below the ceramic ring and tapers inwardly towards the bottom. While the elastic lining, due to its elasticity, is hardly worn by the grinding material bodies, it has turned out that the ceramic ring experiences large wear as a result of continuous exposure to grinding bodies, wherein, in particular, grinding material bodies collect in the gap and, through their abrasive effect, grind down the ceramic ring in the region of its inner upper edge thereby forming a step having a depth of 3 mm to 5 mm, within a short period of time. Grinding material can collect therein and accumulates up to the lower edge of the lining of the stationary wall to cause further wear of the ceramic part in response to the relative motion between the wall and the plate parts. The ceramic part must therefore be replaced after a short period of time.

It is the underlying purpose of the present invention to further develop a grinding machine of the above-mentioned type which has a longer service life.

SUMMARY OF THE INVENTION

This object is achieved in accordance with the invention by a grinding machine of the above-mentioned type, characterized in that the gap is limited from the top by a ceramic part and from the bottom by an elastic part. It has surprisingly turned out that, compared to prior art, the abrasive effect of the grinding material bodies on the ceramic part is much less if the ceramic part is disposed on the lower side of the stationary wall, wherein the ceramic ring limits the gap from above. The gap is limited from below by the elastic lining of the rotary plate part. The reason for the reduced wear may be that, although a small step also forms in the region of the inner lower edge of the ceramic ring due to the abrasive effect of the grinding material bodies, grinding material cannot collect and accumulate therein, since it is constantly removed by the undamaged opposite edge of the elastic lining of the plate part.

The invention therefore provides for a much longer service life compared to prior art. The ceramic ring must only be replaced after a much longer period of use.

The elastic part of the plate part is preferably a lining thereof while the ceramic part is a ceramic ring. Preferably, surfaces are provided between the two opposite planes which are preferably oriented horizontally and perpendicularly with respect to the axis of rotation. They can also incline slightly towards the inside with respect to the horizontal, e.g. in a range of 10° to 30°. The axis of the grinding machine is usually vertical. A particularly preferred embodiment of the invention is characterized in that the ceramic part has a nose-like projection extending downwardly, wherein, in particular, the inner wall of the plate part and wall part are formed substantially conically, tapering from the top towards the bottom above and below the gap. The conical inclination of the inner wall with respect to the vertical axis of rotation can thereby be 30° to 45°. Both, this inclination of the plate part directly below the gap as well as the conical inclination extending inwardly and downwardly of the inner wall of the wall part, support the abrasion-preventing arrangement of the gap-limiting ceramic part on the upper wall part and the elastic part of the rotary plate limiting the lower side of the gap.

Further advantages and features of the invention can be extracted from the claims and the following description which show, in detail, an embodiment of the invention with reference to the drawing.

DESCRIPTION OF THE PREFERRED EMBODIMENT

Figure 1:
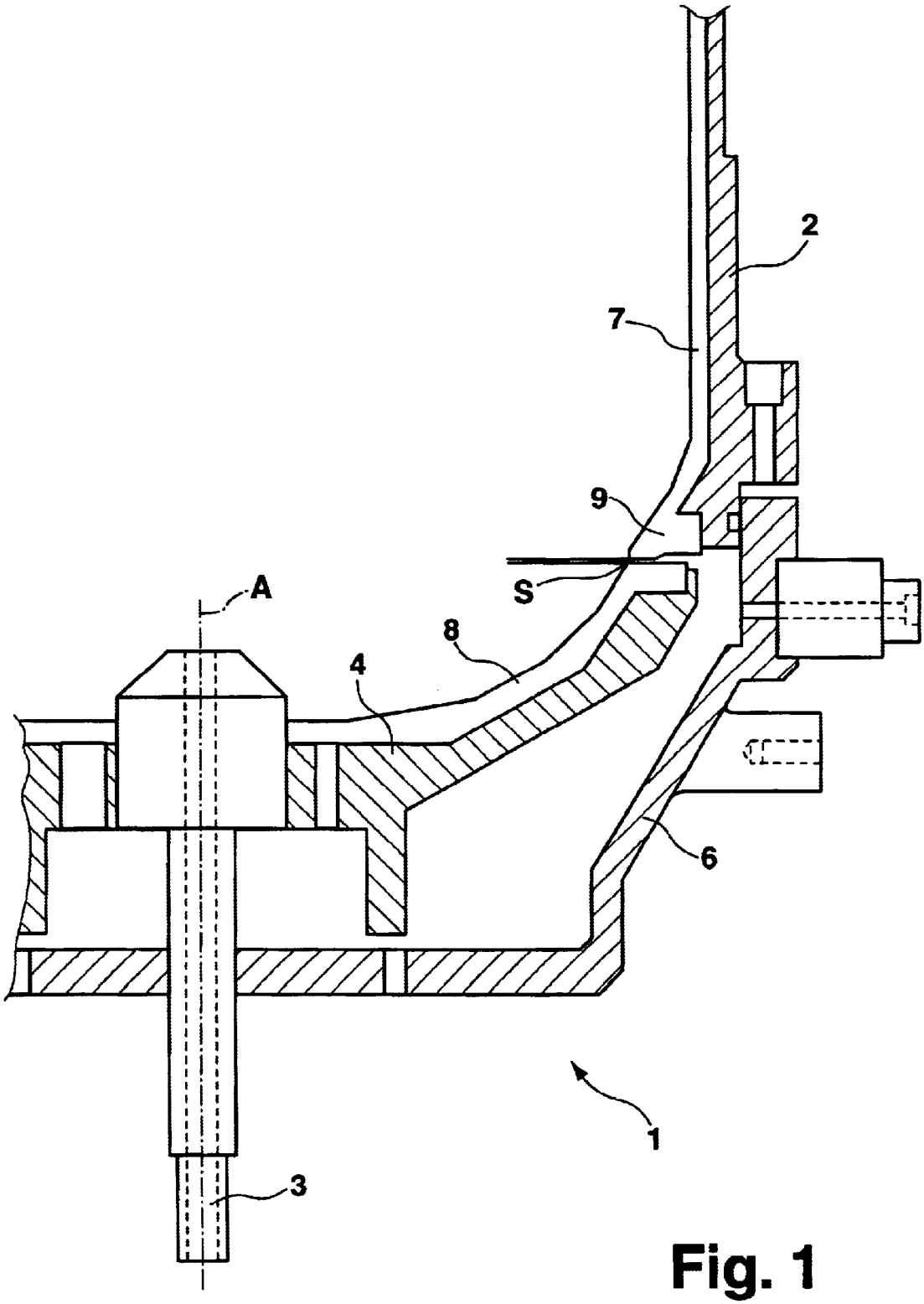
FIG. 1 shows a vertical section through a preferred embodiment of the inventive grinding machine, partly cut.
Figure 2:
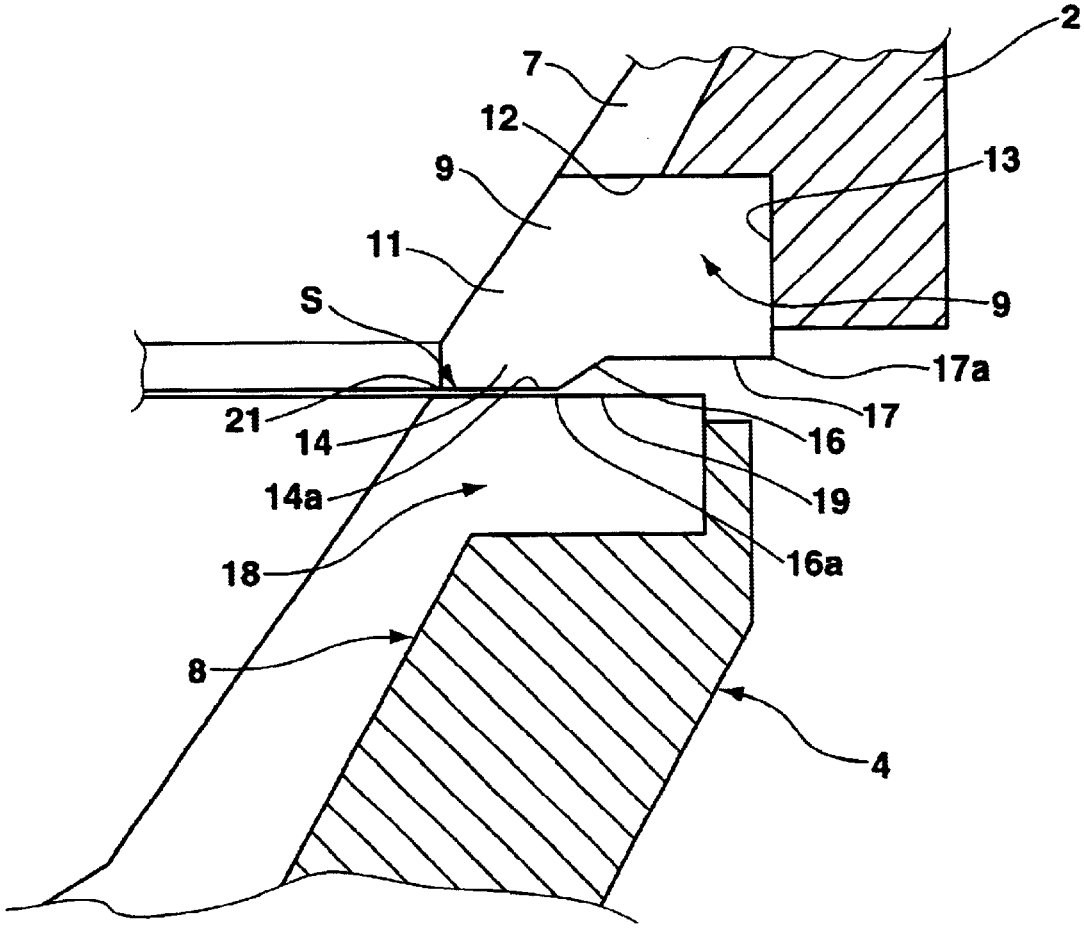
FIG. 2 shows an enlarged detailed representation of the device of FIG. 1.

FIG. 1 shows a vertical longitudinal section of a preferred embodiment of an inventive grinding machine 1. The grinding machine is symmetrical about its axis of rotation A such that substantially only the right part of the vertical section is shown. The inventive grinding machine 1 comprises a stationary wall part 2 below which a plate part 4 is provided which is rotated about the axis A by a drive shaft 3. Outside of the plate part 4 and surrounding same a stationary lower part 6 can be adjacent to the lover side of the wall part 2. These components are substantially metallic, e.g. aluminum. The wall part 3 and the bottom part 4 have an elastic lining 7, 8 on their inner side, preferably of polyurethane. The lower side of the wall part 2 comprises a ceramic ring 9 which is firmly connected to the wall part 2.

The lower region of the inner wall of the elastic lining 7 and thereby of the wall part 2 exhibits a tapered inclination with respect to the vertical line defined by the axis of rotation A, wherein the angle of inclination can be in the range of e.g. 30° to 45°. The ceramic ring 9 has an inner wall 11 which substantially extends at that same inclination and an upper wall side 12 and rear wall 13 which are directed substantially perpendicular to each other and perpendicular and parallel with respect to the axis A, respectively. The lower inner side of the ceramic ring has a nose-like downwardly extending projection 14 which merges in its rear region, via an inclination 16 slanting upwardly from an edge 16*a* and outwardly, into an outer lower wall region 17 extending horizontally, perpendicular with respect to the axis of rotation A, up to the outer edge 17*a* of the ceramic ring 9. The inclination 16 can also extend continuously from the edge 16*a* to the edge 17*a*, wherein the horizontal region 17 is omitted.

The upper side 19 of the elastic lining 8 of the plate part 4 angles outwardly to form a projection 18, which extends substantially along the upper side 19 of the plate part 4. The upper surface of the projection 18 is flat and extends parallel to the lower side of the nose 14*a*.

The grinding machine 1 is operated by inserting workpieces, such as rings or the like, and grinding material into the inner space formed by the wall 2 and plate 4 and rotating the plate part 4 at a high speed thereby grinding the workpieces with the grinding material. During operation, the grinding material reaches the region of the gap S. Due to the elasticity of the elastic lining 8, the abrasive effect on it is relatively small. The abrasive effect is larger on the ceramic ring, in particular in the region of its inner lower edge 21.

It has turned out that the abrasive effect and therefore the wear of the ceramic ring is considerably smaller with the inventive design compared to that of prior art.

List of Reference Numerals

1 Grinding machine
2 wall part
3 drive shaft
4 rotary plate part
6 stationary lower part
7 elastic lining
8 elastic lining
9 ceramic ring
11 inner wall
12 upper wall side
13 rear wall
14 nose-like projection
14*a* nose
16 inclination
17 lower wall region
18 projection
19 upper side
A axis of rotation
S gap

I claim:

1. A grinding machine comprising:

a stationary wall member;

a plate member disposed for rotation about an axis;

a ceramic part integral with one of said wall member and said plate member; and an elastic part integral with an other of said wall member and said plate member, wherein said ceramic part is disposed vertically above said elastic part, wherein said elastic part has a flat surface and wherein said ceramic part has a downwardly directed nose-like projection, the flat surface of the elastic part and the nose-like projection of the ceramic part facing each other and the upper surface of the elastic part extending parallel to the lower side of the nose-like projection.

2. The grinding machine of claim 1, wherein said ceramic part is a ceramic ring disposed in a lower region of said wall member.

3. The grinding machine of claim 1, wherein said axis of rotation is vertical.

4. The grinding machine of claim 1, wherein an inner wall of said plate member and an inner wall of said wall member taper from a top towards a bottom above and below said gap in a substantially conical manner.

5. The grinding machine of claim 4, wherein said taper defines an angle of inclination relative to said axis of rotation of between 30° and 45°.

6. A grinding machine comprising:

a stationary wall member;

a plate member disposed for rotation about an axis;

a ceramic part integral with one of said wall member and said plate member; and an elastic part integral with an other of said wall member and said plate member, wherein said ceramic part is disposed vertically above said elastic part, wherein said elastic part has a flat surface and wherein said ceramic part has a downwardly directed nose-like projection, the flat surface of the elastic part and the nose-like projection of the ceramic part facing each other and the upper surface of the elastic part extending parallel to the lower side of the nose-like projection, wherein furtheron the nose-like downwardly extending projection merges in its rear region, via an inclination slanting upwardly from an edge and outwardly.

7. A grinding machine comprising:

a stationary wall member;

a plate member disposed for rotation about an axis;

a ceramic part integral with one of said wall member and said plate member; and an elastic part integral with an other of said wall member and said plate member, wherein said ceramic part is disposed vertically above said elastic part, wherein said elastic part has a flat surface and wherein said ceramic part has a downwardly directed nose-like projection, the flat surface of the elastic part and the nose-like projection of the ceramic part facing each other and the upper surface of the elastic part extending parallel to the lower side of the nose-like projection, wherein said elastic part is integral with a lining of said plate member.

* * * * *